US010336512B2

(12) United States Patent
Stoneberg

(10) Patent No.: US 10,336,512 B2
(45) Date of Patent: Jul. 2, 2019

(54) CLOSURE SYSTEM WITH HINGE HAVING UNIFORM THICKNESS AND ELEVATED CENTER

(71) Applicant: PHOENIX CLOSURES, INC., Naperville, IL (US)

(72) Inventor: Thomas Stoneberg, Buffalo Grove, IL (US)

(73) Assignee: PHOENIX CLOSURES, INC., Naperville, IL (US)

( * ) Notice: Subject to any disclaimer, the term of this patent is extended or adjusted under 35 U.S.C. 154(b) by 0 days.

(21) Appl. No.: 15/720,534

(22) Filed: Sep. 29, 2017

(65) Prior Publication Data

US 2019/0100361 A1 Apr. 4, 2019

(51) Int. Cl.
*B65D 47/08* (2006.01)
*B65D 43/16* (2006.01)

(52) U.S. Cl.
CPC ..... *B65D 47/0804* (2013.01); *B65D 43/162* (2013.01)

(58) Field of Classification Search
CPC ..... B65D 47/0804; B65D 43/162
See application file for complete search history.

(56) References Cited

U.S. PATENT DOCUMENTS 4,403,712 A * 9/1983 Wiesinger ..... B65D 43/162 16/225
4,854,473 A 8/1989 Dubach
5,435,456 A * 7/1995 Dubach ..... B65D 47/0814 215/235
5,437,383 A * 8/1995 Stull ..... B65D 47/0814 215/235
5,913,435 A * 6/1999 Fuchs ..... B65D 47/0814 215/235
6,321,923 B1 * 11/2001 Wood ..... B65D 47/0809 16/225
6,439,410 B1 * 8/2002 Dubach ..... B65D 47/0809 215/235
7,510,095 B2 3/2009 Comeau et al.
7,731,042 B2 * 6/2010 Blomdahl ..... B65D 47/0809 215/235
2006/0163188 A1 7/2006 Lagler
2008/0067141 A1 3/2008 Murakami et al.

* cited by examiner

*Primary Examiner* — J C Jacyna
(74) *Attorney, Agent, or Firm* — Husch Blackwell LLP

(57) ABSTRACT

A closure system can include a body member, cap member, and flexible hinge member joining the body and cap members. The hinge member includes a pair of hinge portions with an opening between them. The hinge portions can include substantially planar segments of uniform thickness, providing hinge portions with uniform thickness along their lengths when the closure system is in open and closed configurations. When the closure system is fully opened, the hinge portions can extend axially between the body and cap members when viewed from above, the substantially planar segments can include end segments that are substantially coplanar to each other and a central segment that occupies another plane parallel to that occupied by the end portions, giving the central portion of the hinge portion an elevated orientation relative to its end portions, or the appearance of a hump when viewed from the side.

20 Claims, 5 Drawing Sheets

CLOSURE SYSTEM WITH HINGE HAVING UNIFORM THICKNESS AND ELEVATED CENTER

BACKGROUND OF THE INVENTION

Closure systems are known which include a first part for engaging the open neck of a container and a second part for acting as a lid, with an integral hinge connecting the first and second parts. The hinges can have sections of varying thickness to allow the hinge to bend when the closure system moves between opened and closed configurations. The thinner sections in such hinges can be weaker than the thicker sections, and can be susceptible to stretching, excessive, deformation, or breakage. When stress is placed upon the hinges, such thinner sections can introduce weak points along the hinge.

There is a need for a closure system with hinges having uniform thickness, and configured to enable the hinge to move and adopt conformations that accommodate the opened and closed configurations of the closure system without compromising the connection between the first and second parts. The absence of thinner sections can provide a hinge portion that is stronger and less susceptible to mechanical failure, decreasing the failure rates of the closure systems and increasing the usable lifespan of the closure systems.

There is also a need for a closure system with a hinge made of a uniform thickness in a conformation providing structural flexibility to the hinge and having a structure that allows the closure system to adopt intermediate configurations other than fully opened and fully closed configurations.

There is also a need for a closure system with a hinge having a simple geometry that can be mass-produced quickly and efficiently, as hinges having variable thicknesses or complicated geometries can be difficult or costly to manufacture.

SUMMARY OF THE INVENTION

This invention relates to a closure system for dispensing articles or substances into or out of containers. It particularly relates to a closure system with a flexible hinge having a substantially uniform thickness throughout its length, the hinge also having a crimp or a dual jog that maintains the uniform thickness when the closure system is in both open and closed configurations.

The structure of any hinge takes advantage of features of the molding materials (i.e., flexibility and capacity to retain a molded shape after being placed under varying degrees of tensile loads that can occur during the repeated closing and opening of the hinge). Unlike other designs that rely on thinned connective areas to focus the bending of the hinge and to compensate for tensile forces in thickened or transitioned regions that confer shape and impart cam function to the hinge, the relatively uncomplicated design of the hinge member can promote the even flow of materials through the hinge structure during the molding process.

Further, hinges tend to fail or break at their thinnest regions. The unique uniform thickness of the hinge members can result in a hinge member lacking a thinned area that would focus stress, resulting in a hinge member that is less prone to breakage and enjoying greater durability than traditional hinges.

It can thus be seen that there has been provided a closure system with a hinge providing improved performance and longer life; which further reduces or eliminates excessive stress on the straps during opening and closing which might cause breaking; and which can be made with minimal added cost.

An aspect of the present invention particularly relates to a closure system for engaging with the open neck of a container including: a body member comprising a base wall and a body skirt, the body skirt for engaging the neck of the container; a cap member comprising a top wall and a cap skirt, the cap member movable between an open position and a closed position, the cap member in the closed position engaging the body member, and the cap member in the open position indirectly contacting the body member via a hinge member; and the hinge member attaching the body member to the cap member, the hinge member comprising two hinge portions separated by an opening, each hinge portion having a uniform thickness and each hinge portion defining a line between the body member and the cap member when the cap member is in the open position; and when the cap member is in the open position, each hinge portion comprises an elevated central segment and end segments on opposite sides of the central segment, the elevated central segment including top and bottom surfaces that are parallel to, but not coplanar with, top and bottom surfaces of the end segments.

Another aspect of the invention can relate to the base wall of the body member comprising a spout for communicating with an interior of the container, and the cap member comprising a corresponding plug for engaging the spout when the cap member is in the closed position.

An additional aspect of the invention relates to an exterior edge of the hinge portion that is longer than an interior edge of the hinge portion.

A further aspect of the invention relates to the hinge portion having a substantially trapezoidal shape.

The invention can include one end segment of each hinge portion attaching to the body skirt along an arc running along the base edge of the body skirt, and the other end segment of each hinge portion attaching to the cap skirt along an arc running along the skirt rim of the cap skirt.

The invention can relate to the uniform thickness of each hinge portion being greater than or equal to 0.010 inches and less than or equal to 0.022 inches.

The invention can include a closure system having a gap arc width being defined as the distance between the interior edges of neighboring hinge portions where the interior edges attach to the body skirt, measured along a base edge of the body skirt, and a hinge arc width being defined as the distance between the exterior edges of neighboring hinge portions where the exterior edges attach to the body skirt, measured along a skirt rim of the cap skirt; where the ratio of the hinge arc width to the gap arc width is greater than or equal to 4.

Another aspect of the present invention particularly relates to a closure system comprising: a body member having a body skirt for engaging the neck of a container; a cap member moveable between an open position and a closed position, directly contacting the body member when in the closed position; and a plurality of spaced-apart hinge portions joining the body member to the cap member, each hinge portion comprising a first end segment joining the body member, a second end segment joining the cap member, and a central segment therebetween that occupies a different plane than a plane occupied by the end segments; where each segment has first and second surfaces on opposite sides of the segment, and segment has a longitudinal axis through a central portion and having substantially the same thickness through a cross-section of the segment along the longitudinal axis of each segment, and at least one segment occupying a different plane than the other segments; and when the cap member is in the open position, each hinge portion defines a straight line between the body member and the cap member.

A further aspect of the invention can include each cross-section along each longitudinal axis of the hinge portion having substantially the same depth at every point throughout the cross-section.

Another aspect of the invention can include the distance between the points where the exterior edges of two neighboring hinge portions meet the body member defining a hinge width; the distance between the points where the interior edges of the neighboring hinge portions meet the body member defining a gap width; and the ratio of the hinge width to the gap width being greater than or equal to 1 and less than or equal to 3. In some further aspects of the invention, the ratio of the hinge width to the gap width is about 1.9.

Some aspects of the invention include each hinge portion having a uniform thickness greater than or equal to 0.010 inches and less than or equal to 0.022 inches.

Aspects of the invention can include the closure system such that when the cap member is in the open position, the first surfaces of the end segments and the second surface of the central segment define a common plane.

Another aspect of the present invention particularly relates to a molded closure system comprising: a body member for engaging with the mouth of a container; a cap member movable between an open position and a closed position; and a hinge member attaching the body member to the cap member, the hinge comprising two hinge portions separated by an opening, each hinge portion including a first connecting segment, a first transition segment, a central segment, a second transition segment, and a second connecting segment, respectively, the segments defining a plane between the body member and the cap member, and each segment having the same thickness throughout a cross-section along a longitudinal axis through a central portion of each segment; and when the cap member is in an open configuration, the connecting segments are coplanar to each other and the central segment defines a plane substantially parallel to the connecting segments; and when the cap member is in a closed configuration, the connecting segments define planes that are substantially parallel to each other and substantially perpendicular to the central segment.

Some aspects of the invention include each hinge portion defining a parallel path between the body member and the cap member.

Some aspects of the invention include each hinge portion having a uniform thickness greater than or equal to 0.010 inches and less than or equal to 0.022 inches.

The invention can also encompass the interior edges of neighboring hinge portions defining a gap arc width between the points where the interior edges join a cap skirt of the cap member; the exterior edges of the hinge portions defining a hinge arc width between the points where the exterior edges join the cap skirt; and the ratio of the hinge arc width to the gap arc width being greater than or equal to 4.

In some aspects of the invention, the transition segments occupy different planes than the central segment and the connecting segments when the closure is in the open or closed configurations.

In some aspects of the invention, each hinge portion includes a substantially trapezoidal portion and each hinge portion has an interior edge defining the opening and an exterior edge on the side opposite the interior edge, the edges being substantially parallel to each other; with each interior edge of each hinge portion comprising a short base of the trapezoidal shape, and each exterior edge of each hinge portion comprising a long base of the trapezoidal shape; and a first connecting segment defining a first trapezoid leg of the trapezoidal shape joining a body skirt of the body member and a second connecting segment defining a second trapezoid leg of the trapezoidal shape joining a cap skirt of the cap member.

BRIEF DESCRIPTION OF THE DRAWINGS

The features of the present invention which are believed to be novel are set forth with particularity in the appended claims. The drawings may not be to scale. The invention can best be understood by reference to the following description taken in conjunction with the accompanying drawings.

DETAILED DESCRIPTION OF THE INVENTION

Figure 1:
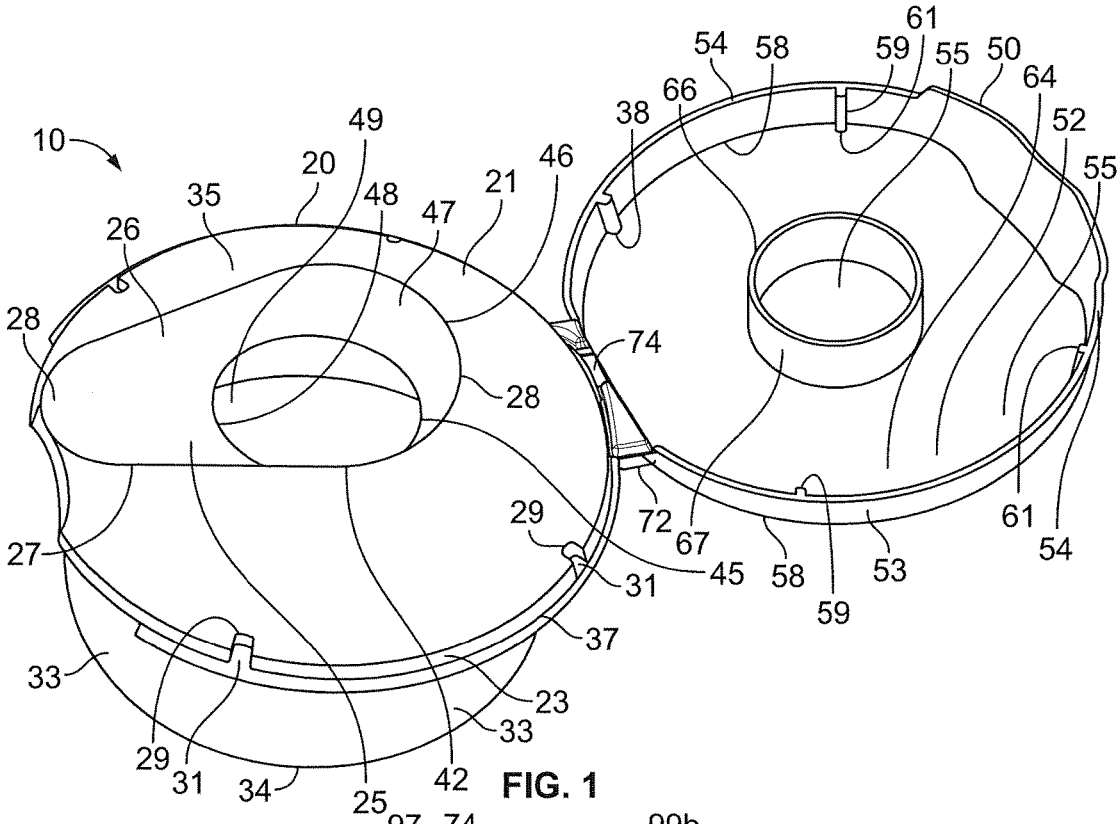
FIG. 1 shows a perspective view of an embodiment of a closure system.

This invention relates to closure systems which include a body for engaging a container and a cap for the container, the body and cap connected to each other by a flexible hinge having a uniform thickness throughout the hinge.

Referring to FIGS. 1-8, the closure system 10 embodying the invention includes a body member 20 which is adapted to be threaded onto, or otherwise engage, the neck of a container; a cap member 50 which acts as a cap or lid to cover the container; and a hinge member 70 connecting the body member 20 and the cap member 50 so that the cap member 50 can move between an open position for dispensing a substance or flowable material into or out of the container and a closed position for securing the contents of the container.

The hinge member 70 can include a design of almost strap-like simplicity and a cam-inducing structure. The hinge member 70 can include a strong uniform thickness 76 for providing high durability. These features can also facilitate less restrictive material flow during the molding process of the hinge member 70.

The Body Member

The body member 20 can engage the closure assembly 10 to a container. As shown particularly in FIGS. 1-3, the body member 20 can include a base wall 21 and a body skirt 33 with a shoulder 37 at the juncture of the base wall 21 and the body skirt 33. The body skirt 33 can also include a base edge 34 opposite the shoulder 37. A spout 42 can extend from a portion 35 of the base wall 21, preferably near the center of the base wall 21.

The spout 42 can be generally tubular; a spout 42 can include one end 46 with a mouth 47 for communicating with the cap member 50, and another end 48 with a mouth 49 for communicating with the interior of the container. Each spout mouth 47, 49 can be a round or oval opening, or any other shape commonly used for spouts. A flowable material can move through the spout 42 into and out of the container when the closure system 10 is engaged with the container.

Figure 2:
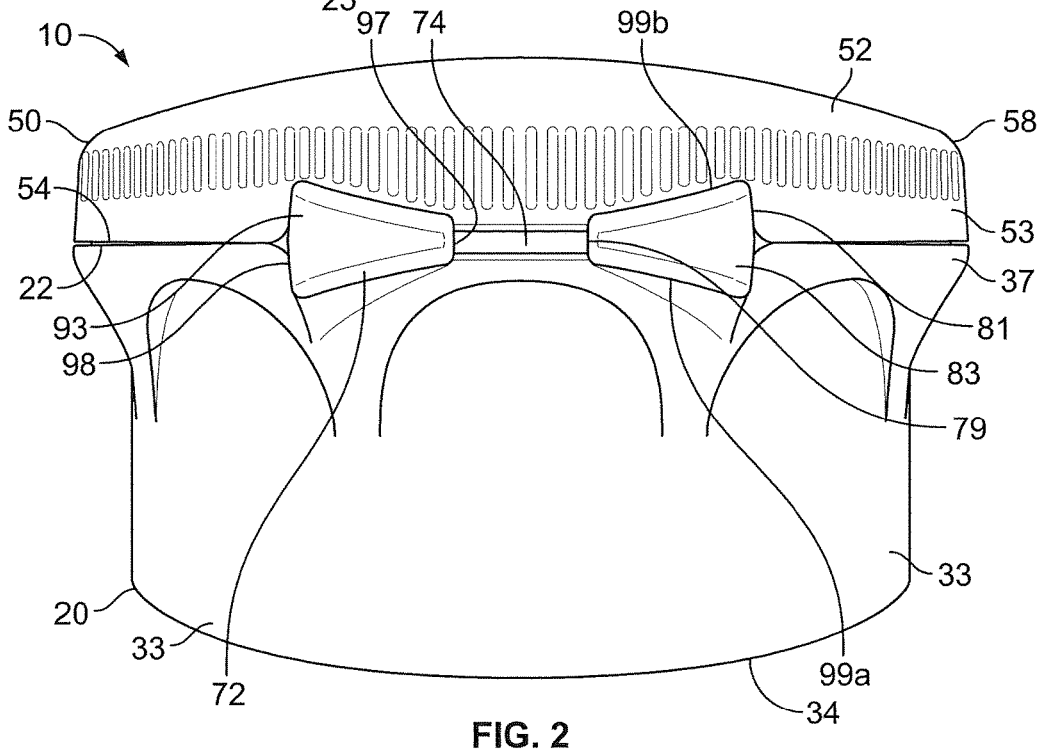
FIG. 2 shows a rear view of a closure system in a closed configuration.
Figure 3:
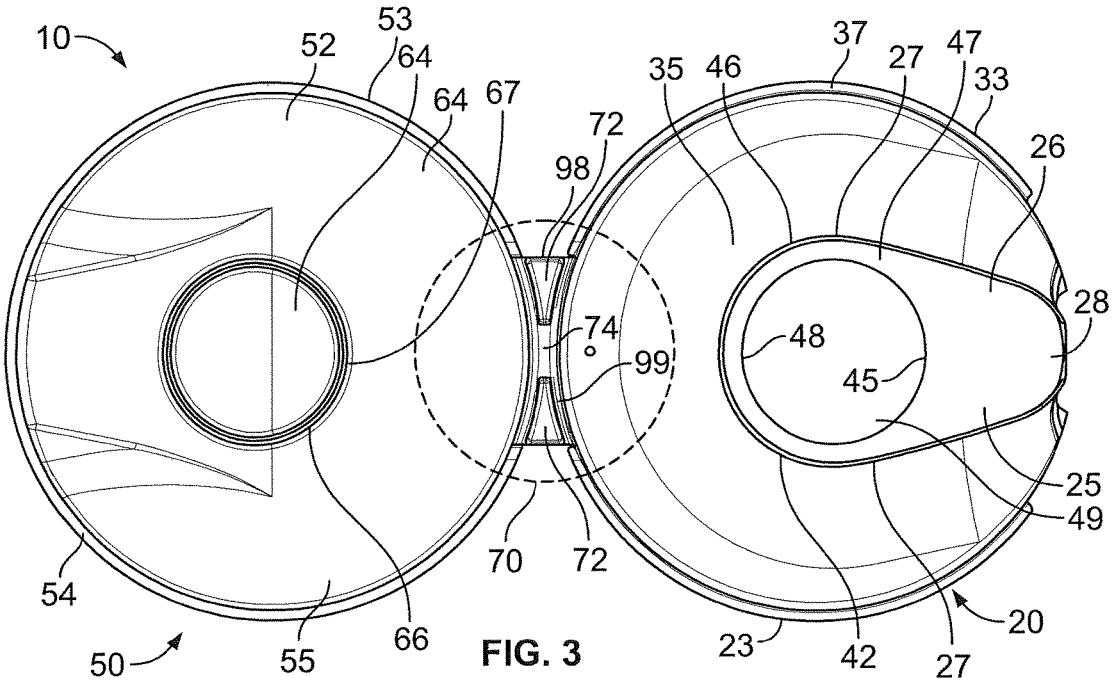
FIG. 3 shows a top view of a closure system in an open configuration.

In some embodiments, the base wall 21 can be flat and form a substantially or fully right angle where the base wall 21 meets the body skirt 33, forming a perimeter 23 around the body skirt 33. Either, both, or neither spout mouth can be generally coplanar with the base wall 21. As shown in FIGS. 1-3, the base wall 21 can slope, curve, or arc between the body skirt 33 and the exterior spout mouth 49, so that an exterior spout mouth 49 is substantially or fully parallel to the base wall 21, but is located on a different plane than the base wall 21. In preferred embodiments, the spout 42 protrudes up and away from the base wall 21, away from the container, when the closure system 10 is engaged onto a container, and extends toward a corresponding plug 66 located on the interior surface 64 of the cap member 50. In some embodiments, the exterior spout mouth 49 reversibly engages the corresponding plug 66; in some embodiments, the structures can form a sealing engagement.

The base wall 21 can include a dispensing channel 25 for guiding flowable materials from the spout 42 and away from the closure system 10. The dispensing channel 25 can define a depression 26 in the base wall 21 that surrounds or encircles the spout 42. The depression 26 can include a raised peripheral edge 27 that is above the exterior spout mouth 49 and/or above the base wall 21. The depression 26 can define the path taken by flowable materials as they are dispensed from the closure system 10. The depression 26 can include an angled or arcing surface between the exterior spout mouth 49 and the raised peripheral edge 27. A portion of the raised peripheral edge 27 can define a lip 28, which can extend to or protrudes past the body skirt 33 for directing the flow of flowable material past the closure system 10 and/or container. The base wall 21 and/or body skirt 33 can be contoured to accentuate the pouring feature of the lip 28, such as by the presence of an indentation in the base wall 21 such that the lip 28 protrudes markedly away from the closure system 10. In some embodiments, the lip 28 can extend away from the closure system 10 without extending past the body skirt 33 and/or cap member 50.

The body skirt 33 can include a shoulder 37 at the juncture of the base wall 21 and a base edge 34 opposite the shoulder 37. The body shoulder 37 and body skirt base edge 34 can have substantially similar shapes and sizes, i.e., both structures being roughly circular with similar diameters. The body shoulder 37 and body skirt base edge 34 can have substantially similar shapes, but different sizes, i.e., both structures being roughly circular with the body shoulder 37 having a larger diameter than the body skirt base edge 34.

In some embodiments, the dispensing channel 25 can be round, oval, triangular, or tear-shaped. While polygonal configurations are envisioned, other embodiments include dispensing channels 25 having a curvilinear shape or have an irregular outline.

The body skirt 33 can be formed with an internal thread on the interior surface thereof for engaging with corresponding thread on the neck of a container. This engagement can be reversible; that is, a user or consumer can remove the closure assembly from the container when desired. This engagement can be a sealing engagement that provides a seal on the container when the closure assembly engages the container and the closure assembly is in a fully closed position. In some embodiments, the body skirt 33 can include an external thread for that make the closure assembly mountable onto a container with a corresponding internal thread. In other embodiments, the body skirt 33 can engage the container with a snap-on connection or other means commonly used in the art.

The Cap Member

The cap member 50 is formed with a top wall 52 and a cap skirt 53 and includes a cap shoulder 58 at the juncture of the top wall 52 and the cap skirt 53. Opposite the cap shoulder 58, the cap skirt 53 can also include a skirt rim 54 adapted to be engaged by the body shoulder 37 of the body member 20. The skirt rim 54 can include one or more alignment means for engaging corresponding alignment means on the base wall 21 and/or body member shoulder 37. As shown in FIG. 1, the skirt rim 54 can include one or more guiding members 59 associated with the internal surface 55 of the cap skirt 53 that engage with one or more corresponding guiding mates 29 in the base wall 21, so that the cap member 50 achieves a closed position when one or more guiding members 59 engage their one or more corresponding guiding mates 29. The guiding members 59 and guiding mates 29 can be evenly spaced around the skirt rim 54 and body member shoulder 37, respectively. In other embodiments, these structures can be distributed in an asymmetrical configuration.

The guiding members 59 can include extensions or protrusions 61 located on the internal surface 55 of the cap skirt 53, the guiding members 59 engaging with one or more corresponding guiding mates 29 that include depressions or receptacles 31 in the base wall 21 to receive the receive the guiding members 59. Where a guiding means is provided, a cap member 50 can achieve a closed position when one or more guiding members 59 engage their one or more corresponding guiding mates 29. Such closed position can provide engagement between the cap and body members 50, 20 as a means of torque transfer between the structures during the application or capping process, and during the disengagement of the closure system 10 from the container.

The cap member 50 is moveable between an open position and a closed position in relation to the body member 20. As shown in FIGS. 1 and 3, a plug 66 can be provided on the inner surface of the top wall 52 of the cap member 50, and be adapted to insert or telescope into the spout 42 when the cap member 50 is moved to closed position. The plug 66 can include a rib to provide a friction fit for the plug 66 to both insure a seal for the contents of the container and clear the spout 42 of contents. Alternatively, the plug 66 can engage the spout 42 in a snug, but not sealed, fit. The plug 66 can include a cylindrical wall 67 extending from the interior surface of the base wall 21, for engaging a correspondingly shaped and sized inner surface 45 of the spout 42. When the cap member 50 is in the closed position, the plug 66 can block the spout 42 to stop the flow of a substance into or out of the container via the spout 42 or passageway.

The Hinge Member

The hinge member 70 joins the body member 20 to the cap member 50 and enables the cap member 50 to reversibly move between an open position for dispensing a flowable material into or out of the container and a closed position for securing the contents of the container. When the closure system 10 engages a container and the cap member 50 is in the open position, the body and cap members 20, 50 can be connected indirectly only by the hinge member 70.

When the closure system 10 engages a container and the cap member 50 is in the closed position, one or more other aligning structures of the cap member 50 can engage corresponding structures on the body member 20. For example, in the closed position, the plug 66 can engage the inner surface 45 of the spout 42. Also in the closed position, the skirt rim 54 of the cap skirt 53 can engage the body shoulder 37 of the body member 20. Also in the closed position, the one or more guiding members 59 can engage their one or more corresponding guiding mates 29.

The hinge member 70 can have a cam function; that is, it can adopt intermediate configurations between the fully opened and fully closed configurations described above.

As shown in FIGS. 3-4, and 5A-5B, the hinge member 70 can include one or more hinge portions 72 that each extend between, and connect or join, the cap member 50 and the body member 20. In some embodiments, opposite ends 88, 89 of the hinge portions 72 attach to the body skirt 33 of the body member 20 to the cap skirt 53 of the cap member 50. In some embodiments, the hinge portions 72 can be mirror images of each other and positioned to provide a symmetrical shape to the hinge member 70.

When the cap member 50 is in the open position and viewed from above, each hinge portion 72 can have a length that defines a straight line between the cap member 50 and the body member 20. The hinge portions 72 can be spaced apart or separated by an opening 74 between them. Each hinge portion 72 can have its opposite ends 88, 89 straight and lying in the same plane when the body member 20 and cap member 50 are in the fully open position. In this position, an interior portion of each hinge portion 72 can inhabit a plane parallel to the planes inhabited by the ends 88, 89 of the hinge portion 72. In some embodiments, the hinge portions 72 can define substantially or fully parallel paths.

Defined by and between the opposite ends 88, 89, each hinge portion 72 can have first and second surfaces 91, 92 on opposite sides of the hinge portion 72, and each surface 91, 92 can include multiple planar portions. When the cap member 50 is in an open position, the surfaces 91, 92 can define top and bottom surfaces of the hinge portion 72.

As shown in FIGS. 5A-5C and 6, each hinge portion 72 can have a uniform thickness 76 throughout its length. In some embodiments, each hinge portion 72 can have a thickness greater than or equal to 0.010 inches and less than or equal to 0.022 inches. In some embodiments, each hinge portion 72 can have a uniform thickness between 0.15 and 0.02 inches, or each hinge portion 72 can have a thickness about 0.02 inches. Perfect uniformity is preferred, but the thickness can have a tolerance of +/−0.002 inches as an acceptable range of deviation. It is preferred that the surface be generally smooth; that is, free of abrupt fluctuations, depressions, protrusions or other variances that disrupt the surfaces of the hinge portion 72.

As shown in FIGS. 2-3, when the cap member 50 is in the fully opened position and viewed from above, each hinge portion 72 can define a plane between the cap member 50 and the body member 20.

When viewed from the side, as shown in FIGS. 5A-5C and 6, in either the open or closed position, the hinge portion 72 can include a plurality of continuous or contiguous segments 84 that together, span the distance between the cap member 50 and the body member 20 and join the two structures to each other. The plurality of segments 84 can include a central segment 85 in the central portion 93 of the hinge portion 72, an end segment 88 joining the central portion 93 of the hinge member 70 to the body member 20, and an end segment 89 joining the central portion 93 of the hinge portion 72 to the cap member 50. The hinge portion 72 can further comprise transition segments 86 connecting the central segment 85 to each end segment 88, 89; all of these segments 84 can have an unvarying depth 76 or thickness throughout each segment 84, as particularly shown in the cross-sections of the hinge portions 72 shown in FIGS. 5A-5C and 6. Each segment 84 in a hinge portion 72 can possess the same constant or unvarying depth 76 throughout the segment 84, although individual segments 84 can attach to neighboring segments 84 at different angles. It is preferred that each segment 84 of a hinge portion 72 have the same thickness or depth 76 when measured at any point in the segment 84.

In some embodiments, each hinge portion 72 can include the following respective arrangement of segments 84, each joined or attached to each other: a first connecting end segment 87*a*, a first transition segment 86*a*, a central segment 85, a second transition segment 86*b*, and a second connecting segment 87*b*. The segments can define a plane between the body member 20 and the cap member 50 when the closure system 10 is in the open configuration, when viewed from above, as in FIG. 3. Each segment 84 can have the same thickness (or thinness or depth 76) throughout the entire segment 84. That is, the central segment 85, and each end segment 87 can have the same uniform thickness 76. Further, the central segment 85, and each end segment 87*a,b*, and each transition segment 86 can have the same uniform thickness 76. In some embodiments, every segment 84 of the hinge portion 72 can have the same depth or uniform 76 thickness through the segments 84. The segments can be flat in shape, and define surfaces that are substantially or fully planar or are gently curved or arcing.

As shown in FIGS. 5A-5C and 6, if a longitudinal axis is drawn through a central part of any segment 84, it is envisioned that the slice or cross-section is made along that axis will provide a profile showing the same thickness or depth 76 throughout the entire cross-section. In some embodiments, if another axis is drawn through the segment 84 that is perpendicular to the longitudinal axis, that profile will have the same thickness or depth 76 throughout that cross-section.

Figure 5A:
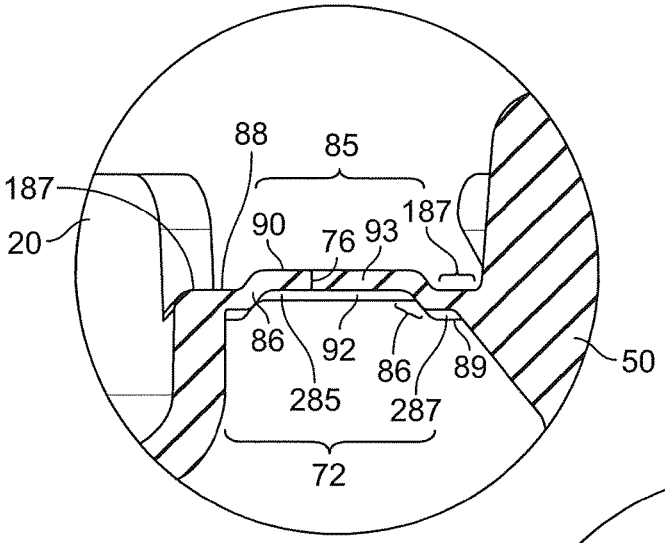
FIGS. 5A-5C show side views of cross-sections of the hinge portion of FIG. 4.
Figure 5B:
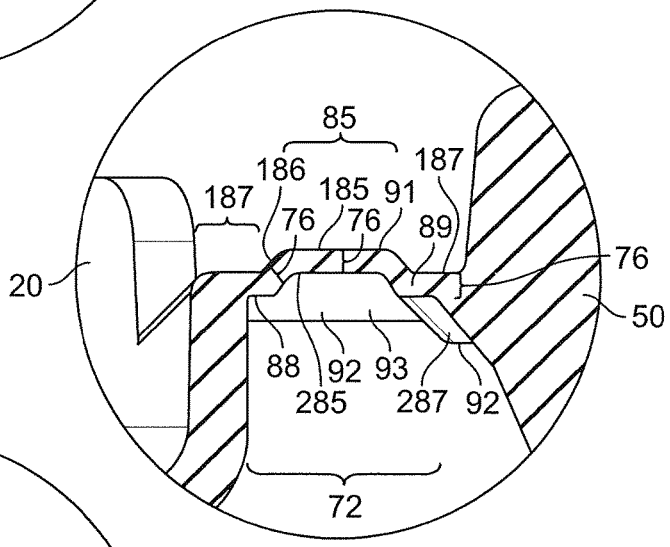
Figure 5C:
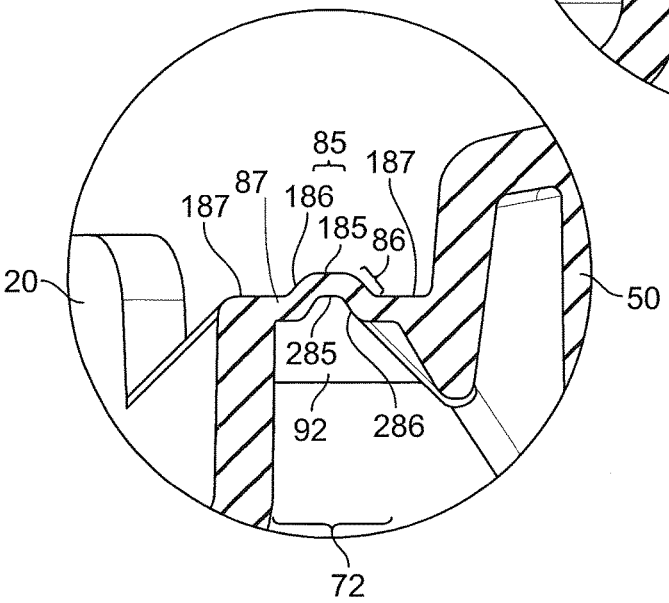
Figure 6:
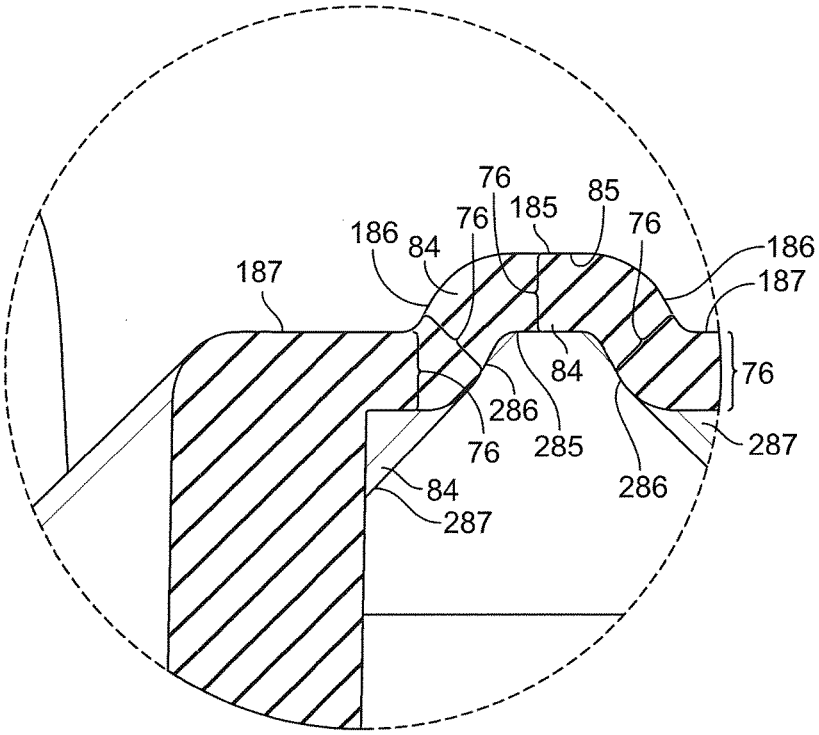
FIG. 6 shows a fragmentary view of a hinge member.

In embodiments shown in FIGS. 5A-5C, the hinge portion 72 can have a first end segment 88 that attaches to the body member 20 and a second end segment 89 that attaches to the cap member 50, and each end segment 87 can be positioned at a substantial right angle to the skirts 33, 53 of the body and cap members 20, 50, respectively. A transition segment 86 can attach to each end segment 87, angling upward and inward toward a central axis of the hinge portion 72. The upward-angling transition segments 86 can be joined to the central segment 85 that is positioned in a plane substantially or fully parallel to the end segments 87. The segments 84, 85 can be angled such that they form an elevated central portion 93 within the hinge portion 72; that is, the central portion 93 can be positioned at a different elevation than that of the end segments 87. Alternatively, the angled transition segments 86 can be positioned in off-set layers or planes that share common surfaces on the interior and exterior edges 79, 81 of the hinge portions 72, but also introduce a dual jog shape (or hump or ridge or U-shape) within the side profile of the hinge portion 72. The hinge portion 72 can describe a straight, linear path when viewed from above, but simultaneously describe a path when that is not straight when viewed from the side.

Whether the closure system 10 is in an open or closed configuration, at least one segment 84 can occupy a different plane than the other segments 84.

The elevated central portion 93 of the hinge portion 72, which can also be described as a dual job shape, or upraised crimp, can add structural flexibility and shape memory to the hinge that is in line with the tensile forces that contribute to the cam inducing capacity of the structure of the hinge member 70. The dual jog can allow for considerably high elongation distance as the jog height becomes reduced upon the application of force, providing a more resilient hinge structure and increased ability for dimensional recovery. As force is applied to the hinge member 70, the force can act to flatten or straighten the elevation (or upraised crimp) in the central portion 93 of the hinge member 70, providing more hinge segment elongation and improved recovery as the hinge segment 84 can behave as a tensile spring to impart a cam hinge feel to a user.

Each hinge portion 72 can have first and second surfaces 91, 92 on opposite sides of the hinge portion 72 that span between the opposite ends 88, 89 of each hinge portion 72. Each segment of the hinge portion 72 can have first and second surfaces on opposite sides of each other, each first surface making up a part of the first surface 91 of the hinge portion 72 and each second surface making up a part of the second surface 92 of the hinge portion 72. That is, each central segment 85 can have first and second surfaces 185, 285; each transition segment 86 can have first and second surfaces 186, 286; and each end segment 86, 87 can have first and second surfaces 187, 287. The first surfaces of each segment can be aligned along or present on the first surface 91 of the hinge portion 72 and the second surfaces of each segment can be located on the second surface 92 of the hinge portion 72, such that the first and second surfaces of the segments and the hinge portion 72 are located on opposite sides of the segments or hinge portion 72, respectively.

When the body member 20 and cap member 50 are in the fully open position, as in FIGS. 5A-5C and 6, the first surfaces 187 of the end segments 87 can define a common plane that encompasses both first surfaces 187. In preferred embodiments, the second surface 285 of the central segment 85 can occupy the same common plane as the first surfaces 187 of the end segments 87. These surfaces 187, 285, 187 can be indirectly connected to each other, and it is preferred that the surfaces not contact each other or directly connect to each other.

When the cap member 50 is moved between the open and closed positions, the segments 84 can change position relative to each other to adopt an extended configuration when the cap member 50 is in the open position, and to adopt a secured configuration when the cap member 50 is in the closed position.

When in the extended (or fully open) configuration and viewed from the side, each hinge portion 72 can include a central segment 85 and end segments 87 that define planar or substantially planar structures, where the segments 85, 87 are substantially or fully parallel to each other. In this position, the end segments 87 can be substantially or fully coplanar with each other, while the central segment 85 occupies a plane that is parallel to, but not coplanar with the end segments 87. In effect, the central segment 85 can appear to have an offset or elevated (upraised or lowered, depending on the orientation of the hinge portion) orientation when compared to the end segments 87.

When in the secured (or fully closed) configuration and viewed from the side, the end segments 87 can be substantially or fully parallel to each other. The central segment 85 can occupy a plane that is substantially or fully perpendicular to the end segments 87, or some other plane that is not parallel to a common plane occupied by the end segments 87. Where the closure system 10 and/or the hinge member 70 is made of a flexible material, the end segments 87 can bend or flex slightly to accommodate the uniform thickness 76 of the hinge portion 72.

As shown in FIGS. 1-4, a hinge member 70 can include a pair of neighboring hinge portions 72, and each hinge portion 72 can include an interior edge 79 that spans the gap or opening 74 between neighboring hinge portions 72, as well as an exterior edge 81 on the side opposite the interior edge 79. The interior edge 79 can have length that is shorter than the length of the exterior edge 81. Such differences in length can provide the central portion 93 or central segment 85 of hinge portion 72 with a shape that is substantially or fully trapezoidal or triangular. In some embodiments, the shapes can have curvilinear variations on trapezoid sides or edges. The hinge portion 72 itself can have a trapezoidal shape, as well.

Where the central portion 93 or central segment 85 or hinge portion 72 has a trapezoidal shape, each trapezoid can include two bases 97, 98, where a first base 97 can have a shorter length than a second base 98 and a pair of legs 99 spanning between the two substantially or fully parallel bases 97, 98. A first base 97 can be defined by the interior edge 79 of the hinge portion 72 that defines the opening 74 of the hinge member 70, while the second base 98 can be defined by the exterior edge 81 of the hinge portion 72.

The hinge portions 72 can be arranged so that their short first bases 97 face each other on opposite side of the opening 74 and positioned such that the hinge portions 72 appear as mirror images of each other in the hinge portion 72. Each central portion 93 or central segment 85 can have a first leg 99*a* that is positioned along the body skirt 33 of the body member 20 and a second leg 99*b* that is positioned along the cap skirt 53 of the cap member 50. Each end 88, 89 of the hinge member 70 can attach to the body member 20 and cap member 50 at an angle or an arc that is not parallel to the base edge 34 of the body skirt 33 or the skirt rim 54 of the cap skirt 53. Thus, the ends can preserve an overall trapezoidal shape to each hinge portion 72. Similarly, the first and second legs 99*a*, 99*b* can attach to the body member 20 and cap member 50 at an angle or an arc that is not parallel to the base edge 34 of the body skirt 33 or the skirt rim 54 of the cap skirt 53.

As shown in FIGS. 2, 4, and 8A-8C, each end 88, 89 of the hinge portion 72 can have an arced shape that extends between the interior and exterior edges 79, 81 of the hinge portion 72. In some embodiments, the ends can describe a straight line that connects the end to the interior and exterior edges 79, 81 of the hinge portion 72. The ends can be symmetrical around a longitudinal axis through the central segment 85 or the center of the hinge portion 72. Neighboring hinge portions 72 can be mirror images of each other.

Figure 7:
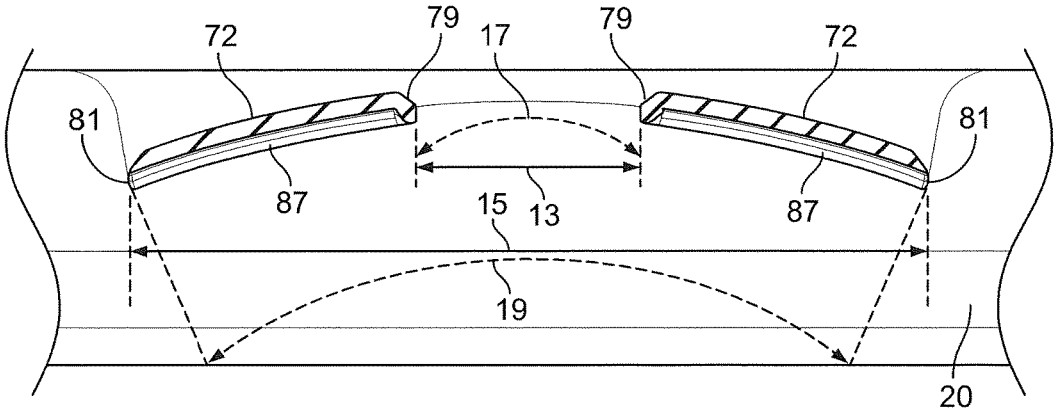
FIG. 7 shows a fragmentary view of a hinge member of a closure system.
Figure 8A:
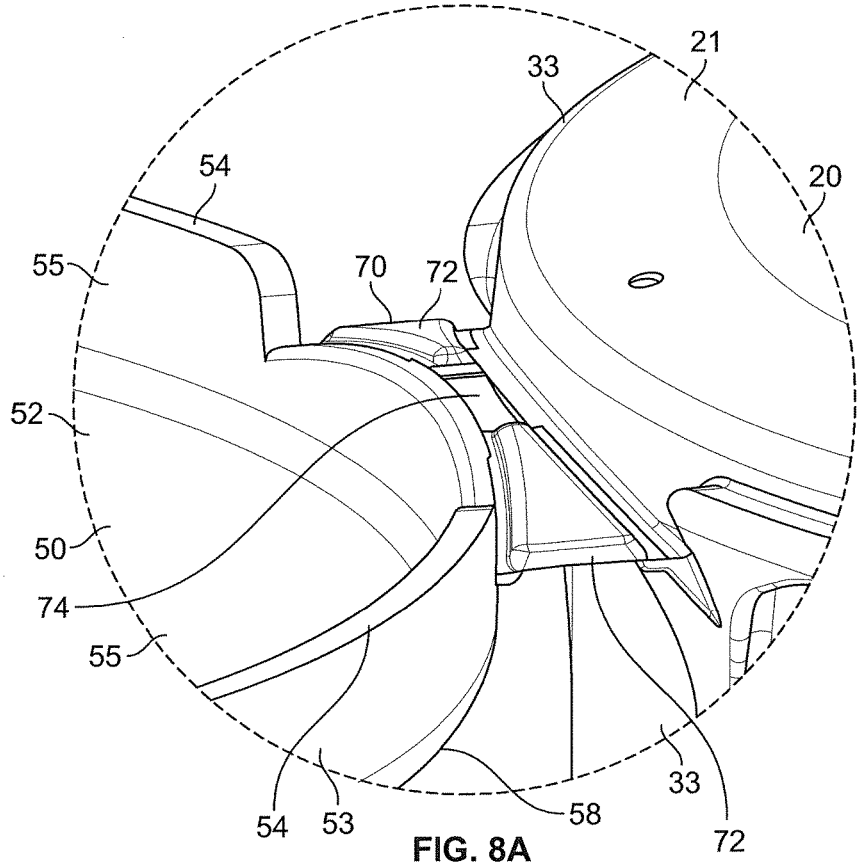
FIGS. 8A-8C show hinge portions, with FIG. 8A showing a fragmentary view of the hinge portions in a hinge member and FIGS. 8B and 8C showing perspective views of a hinge portion from above and below, respectively.
Figure 8B:
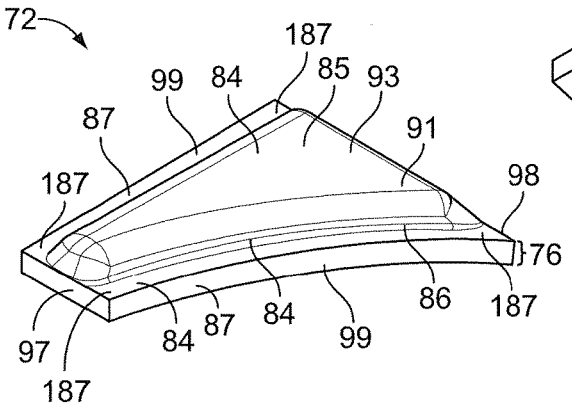
Figure 8C:
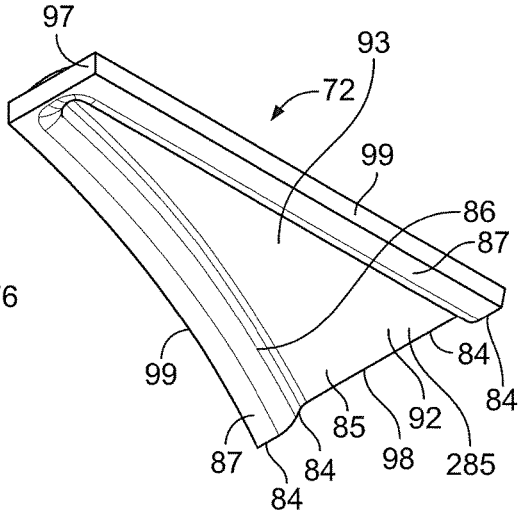

As shown in FIG. 7, the width of the hinge member 70 can be defined as the distance between the two hinge portions 72, preferably neighboring hinge portions 72. A hinge member 70 can have a first hinge width 15 defined by the distance between the points where the exterior edges 81 of neighboring hinge portions 72 join the body member 20. A hinge member 70 can have a second hinge width defined by the distance between the points where the exterior edges 81 of neighboring hinge portions 72 join the cap member 50. In some embodiments, the first hinge width 15 and the second hinge width define measurements of the same size. A hinge member 70 can have a first gap width 13 defined by the distance between the points where the interior edges 79 of neighboring hinge portions 72 join the cap member 50. A hinge member 70 can have a second gap width defined by the distance between the points where the interior edges 79 of neighboring hinge portions 72 join the cap member 20. In some embodiments, the first gap width 13 and the second gap width define measurements of the same size.

A first ratio of the first hinge width 15 to the first gap width 13 can be a value less than 12, less than 8, less than 4, or less than 2. In preferred embodiments, the first ratio can be between less than or equal to 4. A second ratio of the second hinge width to the second gap width can be a value less than 12, less than 8, less than 4, or less than 2. In preferred embodiments, the second ratio can be between less than or equal to 4.

A first gap width 13 can have a length that is between ¾, ⅔, ½, ⅓, ¼, and ⅛ of the length of the first hinge width 15; in some embodiments that length is between ½ and ¼ of the first hinge width 15 and in some embodiments, that length is less than or equal to ¾, ⅔, ½, ⅓, ¼, and ⅛ of the length of the first hinge width 15; in some preferred embodiments that length is less than ⅓.

A second gap width can have a length that is between ¾, ⅔, ½, ⅓, ¼, and ⅛ of the length of the second hinge width; in some embodiments that length is between ½ and ¼ of the second hinge width and in some embodiments, that length is less than or equal to ¾, ⅔, ½, ⅓, ¼, and ⅛ of the length of the second hinge width; in some preferred embodiments that length is less than ⅓.

Figure 4:
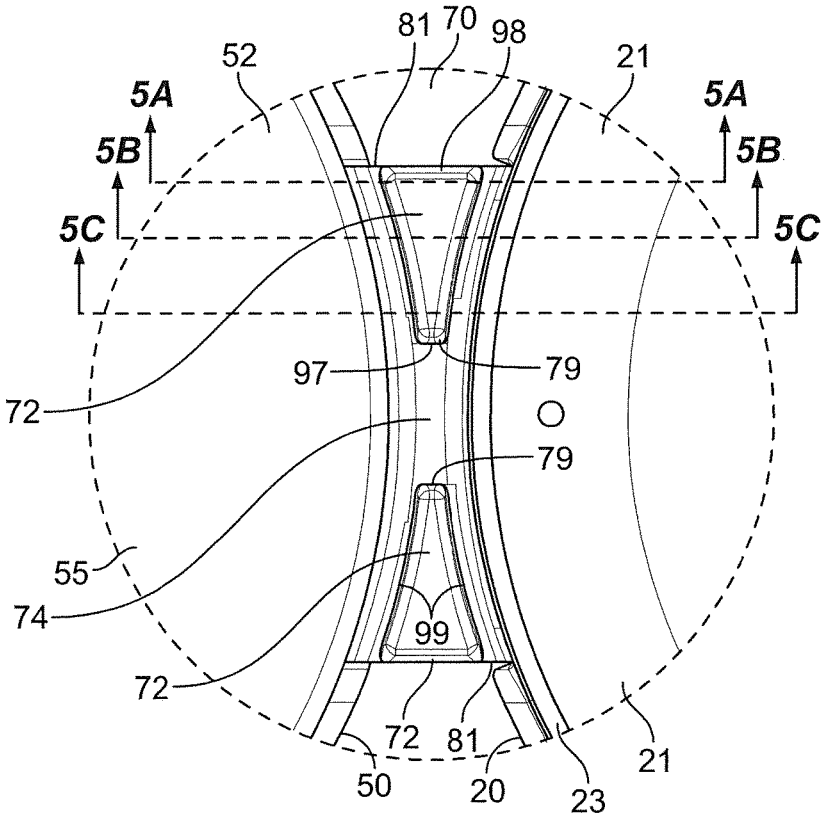
FIG. 4 shows a close up of the hinge member of the closure system of FIG. 3.

As shown in FIG. 4, where the body and cap members 20, 50 have round or circular skirts, a hinge member 70 can have a first hinge arc width 19 defined by the distance traversed by the body skirt 33 between the points where the exterior edges 81 of neighboring hinge portions 72 join the body member 20. A hinge member 70 can have a second hinge arc width defined by the distance between the points where the exterior edges 81 of neighboring hinge portions 72 join the cap member 50. In some embodiments, the first hinge arc width 19 and the second hinge arc width define measurements of the same size. Where the body and cap members 20, 50 have round or circular skirts, a hinge member 70 can have a first gap arc width 17 defined by the distance traversed by the body skirt 33 between the points where the interior edges 79 of neighboring hinge portions 72 join the body member 20, and a hinge member 70 can have a second gap arc width defined by the distance between the points where the interior edges 79 of neighboring hinge portions 72 join the cap member 50. In some embodiments, the first gap arc width 17 and the second gap arc width define measurements of the same size.

A first ratio of the first hinge arc width 19 to the first gap arc width 17 can be a value less than 12, less than 8, less than 4, or less than 2. In preferred embodiments, the first ratio can be between less than or equal to 4. A second ratio of the second hinge arc width to the second gap arc width can be a value less than 12, less than 8, less than 4, or less than 2. In preferred embodiments, the second ratio can be between less than or equal to 4.

A first gap arc width 17 can have a length that is between ¾, ⅔, ½, ⅓, ¼, and ⅛ of the length of the first hinge arc width 19; in some embodiments that length is between ½ and ¼ of the first hinge arc width 19 and in some embodiments, that length is less than or equal to ¾, ⅔, ½, ⅓, ¼, and ⅛ of the length of the first hinge arc width 19; in some preferred embodiments that length is less than ⅓.

A second gap arc width can have a length that is between ¾, ⅔, ½, ⅓, ¼, and ⅛ of the length of the second hinge arc width; in some embodiments that length is between ½ and ¼ of the second hinge arc width and in some embodiments, that length is less than or equal to ¾, ⅔, ½, ⅓, ¼, and ⅛ of the length of the second hinge arc width; in some preferred embodiments that length is less than ⅓.

As shown in FIGS. 2 and 7, the hinge portion 72 can have opposite sides (i.e., 88, 89) configured for attaching to the body member 20 and the cap member 50. In embodiments where the skirts 33, 53 of the body and cap members 20, 50 describe round, oval, or annular surfaces, respectively, the hinge portion 72 can be curved to meet and align along the edges of the skirts 33, 53. In embodiments where the skirts 33, 53 of the body and cap members 20, 50 have flat surfaces where the hinge portion 72 connects the body and cap members 20, 50, respectively, the hinge portion 72 can be flat or substantially flat to connect to the edges of the skirts 33, 53. The opposite sides (i.e., 88, 89 of the hinge portion 72 can define a portion of the base edge 34 of the body skirt 33 and/or a portion of the skirt rim 54 of the cap skirt 53.

Configurations of the Closure System

The closure system 10 can adopt a fully open configuration (during which articles or substances can be transferred into or out of the container); a fully closed configuration (during which the closure system 10 acts as a cap or lid for the container and bars the transfer of articles or substances into or out of the container); and at least one intermediate or in-between configuration (during which the interior of the container is accessible to an individual or user). The closure system 10 can facilitate the transfer of articles or substances through a mouth of a container.

As shown in FIGS. 1-2, the hinge member 70 can provide the sole connection between the body and cap members 20, 50 when the closure system 10 is in the intermediate and fully open configurations. This indirect connection remains present when the closure system 10 is in the fully closed configuration, but in the fully closed configuration the cap skirt 53 of the cap member 50 can also directly engage the base wall 21 (and/or the cap skirt 53 and body skirt 33) of the body member 20. In some embodiments, the structures can achieve a sealing engagement. The engagement can be reversible; that is, the cap skirt 53 and base wall 21 (and/or body skirt 33) can disengage from each other when the closure system 10 moves from a closed configuration to an open or intermediate configuration.

When the closure system 10 adopts the closed configuration, the plug 66 can engage inner surface 45 of the passageway or spout 42, as described above.

Where a guiding means is provided, when a closed configuration is adopted, one or more guiding members 59 can engage their one or more corresponding guiding mates 29, providing a connection between the body and cap members 20, 50. Each of the body and cap members 20, 50 can include one or more guiding mates 29, guiding members 59, or both structures.

Guiding mates 29 and guiding members 59 can interact as torque transfer structures between the cap and the body members 50, 20 during the capping process as well as during the removal of the closure system 10 from the container.

As shown in FIGS. 4, 5A-5C, 6, and 8A-8C, each hinge portion 72 is configured such that the hinge portions 72 maintain a uniform thickness 76 throughout its length during operation; i.e., in opening and closing the cap member 50. This feature can provide a durable hinge such that the movable portions of the hinge are not subject to stretching or thinning during use. In turn, those movable portions can experience less stress during use and can have greater resistance to adopting altered shapes having decreased operability or increased susceptibility to breakage. This feature can make the closure system 10 less susceptible to mechanical failure and can increase the usable lifespan of the hinge portion 72, and in turn, the closure system 10.

The closure systems 10 can be manufactured by a variety of methods. The closure systems 10 can be machined or molded. For example, the closure systems 10 can be made via injection molding processes. The optimum thickness for the hinge member 70 can be determined by balancing multiple considerations, such as material flow, hinge function, cam function, hinge durability, and tear resistance. The optimum thickness will produce desirable results for most, if not all, of these functions or capabilities.

The present invention is not limited to the particular details of the embodiments depicted, and other modifications and applications are contemplated. Certain other changes can be made in the above-described method without departing from the true spirit and scope of the invention herein involved. It is intended, therefore, that the subject matter in the above depiction shall be interpreted as illustrative and not in a limiting sense.

What is claimed is:

1. A closure for engaging with a neck of a container comprising:

a body member comprising a base wall and a body skirt, the body skirt for engaging the neck of the container;

a cap member comprising a top wall and a cap skirt, the cap member movable between an open position and a closed position, the cap member in the closed position engaging the body member, and the cap member in the open position indirectly contacting the body member via a hinge member; and the hinge member having a uniform thickness throughout the hinge member, the hinge member comprising two hinge portions separated by an opening, each hinge portion attaching the body member to the cap member, and each hinge portion defining a line between the body member and the cap member when the cap member is in the open position;

wherein when the cap member is in the open position, each hinge portion comprises an elevated central segment and end segments on opposite sides of the central segment, the elevated central segment including top and bottom surfaces that are parallel to, but not coplanar with, top and bottom surfaces of the end segments.

2. The closure of claim 1, wherein when the cap member is in the closed position:

a first end of each hinge member attaches to the body skirt along a line that is non-parallel to a base edge of the body skirt; and a second end of each hinge member attaches to the cap skirt along a line that is non-parallel to a skirt rim of the cap skirt.

3. The closure of claim 1, wherein the base wall of the body member comprises a spout for communicating with an interior of the container, and the cap member comprises a corresponding plug for engaging the spout when the cap member is in the closed position.

4. The closure of claim 1, wherein an exterior edge of the hinge portion is longer than an interior edge of the hinge portion.

5. The closure of claim 1, wherein the hinge portion has a substantially trapezoidal shape.

6. The closure of claim 1, wherein:

one end segment of each hinge portion attaches to the body skirt along an arc running along the base edge of the body skirt; and the other end segment of each hinge portion attaches to the cap skirt along an arc running along the skirt rim of the cap skirt.

7. The closure of claim 1 wherein the uniform thickness of each hinge portion is greater than or equal to 0.010 inches and less than or equal to 0.022 inches.

8. The closure of claim 1, wherein:

a gap arc width is defined as a distance between the interior edges of neighboring hinge portions where the interior edges attach to the body skirt, measured along a base edge of the body skirt;

a hinge arc width is defined as a distance between the exterior edges of neighboring hinge portions where the exterior edges attach to the body skirt, measured along a skirt rim of the cap skirt;

the ratio of the hinge arc width to the gap arc width is greater than or equal to 4.

9. A closure system comprising:

a body member having a body skirt for engaging a neck of a container;

a cap member moveable between an open position and a closed position, directly contacting the body member when in the closed position; and a plurality of spaced-apart hinge portions joining the body member to the cap member, each hinge portion having substantially the same thickness throughout the hinge portion, each hinge portion comprising a first end segment joining the body member, a second end segment joining the cap member, and a central segment therebetween that occupies a different plane than a plane occupied by the end segments, each segment having first and second surfaces on opposite sides of the segment, each segment having a longitudinal axis through a central portion and having substantially the same thickness through a cross-section of the segment along the longitudinal axis of each segment, and each segment having the same thickness as the other segments;

wherein when the cap member is in the open position, each hinge portion defines a straight line between the body member and the cap member.

10. The closure of claim 9, wherein each cross-section the hinge portion has the same depth at every point throughout the cross-section.

11. The closure of claim 9, wherein:

a distance between the exterior edges of two neighboring hinge portions defines a hinge width;

a distance between the interior edges of the neighboring hinge portions defines a gap width: and the ratio of the hinge width to the gap width is greater than or equal to 1 and less than or equal to 3.

12. The closure of claim 11, wherein the ratio of the hinge width to the gap width is about 1.9.

13. The closure of claim 9 wherein each hinge portion has a uniform thickness greater than or equal to 0.010 inches and less than or equal to 0.022 inches.

14. The closure of claim 9, wherein when the cap member is in the open position, the first top surfaces of the end segments and the bottom surface of the central segment define a common plane.

15. A closure comprising:

a body member for engaging with a mouth of a container;

a cap member movable between an open position and a closed position; and a hinge member attaching the body member to the cap member, the hinge comprising two hinge portions separated by an opening, each hinge portion including a first connecting segment attaching to the body member, a first transition segment, a central segment, a second transition segment, and a second connecting segment attaching to the cap member, respectively, the segments defining a plane between the body member and the cap member, and each segment having the same thickness as the other segments throughout a cross-section along a longitudinal axis through a central portion of each segment;

wherein when the cap member is in an open configuration, the connecting segments are coplanar to each other and the central segment defines a plane substantially parallel to the connecting segments; and wherein when the cap member is in a closed configuration, the connecting segments define planes that are substantially parallel to each other and substantially perpendicular to the central segment.

16. The closure of claim 15, wherein each hinge portion defines a parallel path between the body member and the cap member.

17. The closure of claim 15, wherein each hinge portion has a uniform thickness greater than or equal to 0.010 inches and less than or equal to 0.022 inches.

18. The closure of claim 15, wherein:

the interior edges of neighboring hinge portions define a gap arc width;

the exterior edges of the hinge portions define a hinge arc width; and the ratio of the hinge arc width to the gap arc width is greater than or equal to 4.

19. The closure of claim 15, wherein the transition segments occupy different planes than the central segment and the connecting segments when the closure is in the open or closed configurations.

20. The closure of claim 15, wherein each hinge portion is trapezoid-shaped, each hinge portion having an interior edge defining the opening and an exterior edge on the side opposite the interior edge, the edges being substantially parallel to each other;

wherein each interior edge of each hinge portion comprises a short base of the trapezoidal shape, and each exterior edge of each hinge portion comprises a long base of the trapezoidal shape; and wherein a first connecting segment defines a first leg of the trapezoidal shape joining a body skirt of the body member and a second connecting segment defines a second leg of the trapezoidal shape joining a cap skirt of the cap member.

* * * * *